US006694530B2

(12) United States Patent
Maloney

(10) Patent No.: US 6,694,530 B2
(45) Date of Patent: Feb. 24, 2004

(54) GOGGLE STRAP ALIGNMENT AND FASTENING GUIDE FOR MOTORCYCLE TYPE HELMET

(76) Inventor: Brad Maloney, 8355 Cherry Blossom La., Holland, OH (US) 43528

( * ) Notice: Subject to any disclaimer, the term of this patent is extended or adjusted under 35 U.S.C. 154(b) by 0 days.

(21) Appl. No.: 10/163,898

(22) Filed: Jun. 4, 2002

(65) Prior Publication Data

US 2003/0093853 A1 May 22, 2003

Related U.S. Application Data

(60) Provisional application No. 60/331,486, filed on Nov. 19, 2001.

(51) Int. Cl.[7] ..... A42B 7/00

(52) U.S. Cl. ..... 2/421; 2/10; 2/425

(58) Field of Search ..... 2/426, 421, 429, 2/439, 450, 452, 425, 424, 422, 410, 10, 13; 224/578

(56) References Cited

U.S. PATENT DOCUMENTS

| | | | | |
|---|---|---|---|---|
| 4,193,133 A | | 3/1980 | Laibach et al. | |
| 4,686,712 A | | 8/1987 | Spiva | |
| 4,796,308 A | | 1/1989 | Bourgeois | |
| 5,628,072 A | * | 5/1997 | Haslbeck et al. | 2/428 |
| 5,636,388 A | | 6/1997 | Hodges | |
| 5,937,439 A | * | 8/1999 | Barthold et al. | 2/439 |
| 5,940,890 A | * | 8/1999 | Dallas et al. | 2/421 |
| D429,495 S | * | 8/2000 | Pritchard | D16/339 |

FOREIGN PATENT DOCUMENTS

| | | | | |
|---|---|---|---|---|
| JP | 10-238528 | * | 9/1998 | F16B/45/00 |
| WO | WO 00/24278 | * | 5/2000 | A42B/3/04 |

* cited by examiner

*Primary Examiner*—Gary L. Welch
(74) *Attorney, Agent, or Firm*—John C. Purdue; David C. Purdue

(57) ABSTRACT

A goggle strap alignment and fastening guide is disclosed. The guide is secured to the sides of a helmet that might be used in an extreme sport, such as personal watercraft racing, snowboarding, and the like. The goggle strap guide comprises a base having a first side, which includes means, preferably an adhesive, for securing the guide to the outside of a helmet. The base has a second side, which has two legs with L-shaped cross-sections extending from opposed edges of the base towards each other to define therewith a partially open strap channel. A strap is received within the channel and the legs restrict up and down movement of the strap while permitting longitudinal movement of the strap within the channel. Preferably, the first side of the base is concave.

10 Claims, 3 Drawing Sheets

GOGGLE STRAP ALIGNMENT AND FASTENING GUIDE FOR MOTORCYCLE TYPE HELMET

BACKGROUND OF THE INVENTION

1. Field of the Invention

The present invention relates generally to helmets and goggles which are used by athletes under extreme conditions, and, more specifically, to a goggle strap guide which is secured to a helmet.

2. Description of the Prior Art

A search directed to the goggle strap guide of the present invention turned up several prior art efforts directed to the problem of keeping goggles, used with helmets, in place under extreme conditions.

U.S. Pat. No. 4,193,133 discloses a detachable helmet goggle bracket including a clamp for clamping the bracket to the edge of a helmet.

U.S. Pat. No. 4,686,712 discloses a goggle mounting system for releasably mounting or securing goggle straps to a helmet.

U.S. Pat. No. 4,796,308 discloses a method for retaining goggles on a helmet. According to the method, two retainers that define hooks are disposed on a helmet, one on each side of the helmet, and portions of the goggle straps are looped over the hooks.

U.S. Pat. No. 5,636,388 discloses goggles and side bands for detachably coupling the goggles to headgear and means for adjusting the vertical position of the side bands.

SUMMARY OF THE INVENTION

The present invention is based upon the discovery of goggle strap guide which is secured to the sides of a helmet that might be used in an extreme sport, such as personal watercraft racing, snowboarding, and the like. The goggle strap guide comprises a base having a first side, which includes means for securing the guide to the outside of a helmet. Such means preferably comprise an adhesive which may be applied in the form of heavyduty, two-sided tape, one side of which can be pre-secured to the first side of the guide base, with the other side covered, temporarily, with release paper. The base has a second side, which has two legs with L-shaped cross-sections extending from opposed edges of the base to define therewith a partially open strap channel. Preferably, the first side of the base is concave to compliment the convex surface of a helmet in the region where the guide is to be attached to the helmet.

Accordingly, it is an object of the present invention to provide a strap guide, which is easily affixed to the side of a helmet.

It is a further object of the invention to provide a strap guide which defines a partially open strap channel for receiving a strap from goggles or the like and which confines the strap to prevent lateral movement or displacement of the strap, while permitting longitudinal movement of the strap within the channel.

It is a further object of the present invention to provide a helmet, including a pair of strap guides according to the invention, to retain goggles pulled over the helmet in place, even under extreme conditions.

These and other objects and advantages of the helmet and strap guides of the present invention will be fully appreciated by those skilled in the art upon reviewing the disclosures herein.

DETAILED DESCRIPTION OF THE PREFERRED EMBODIMENTS

Figure 1:
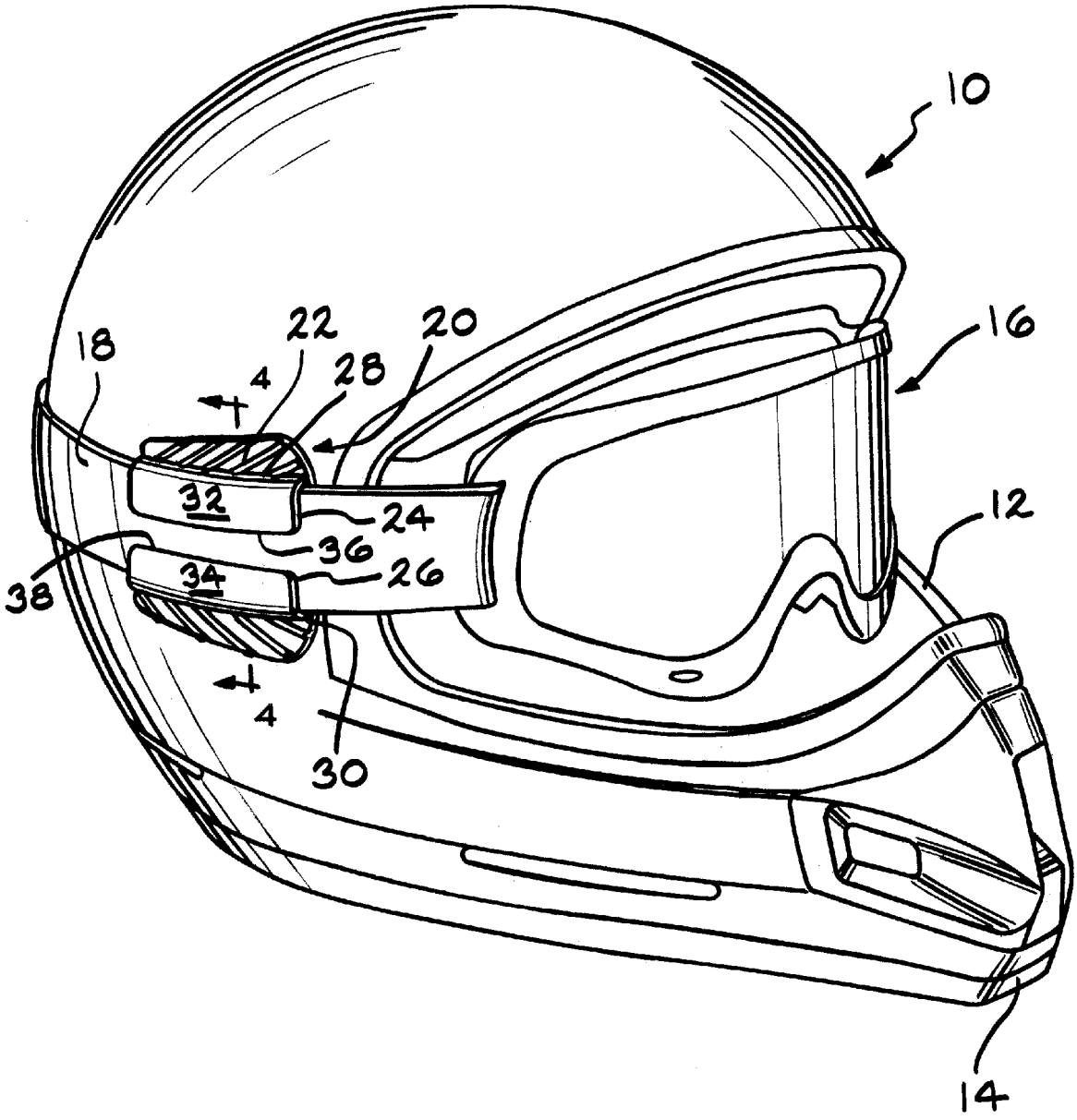
FIG. 1 is a perspective view of a helmet and a pair of goggles including a strap, with the strap retained in strap guides according to the present invention.
Figure 2:
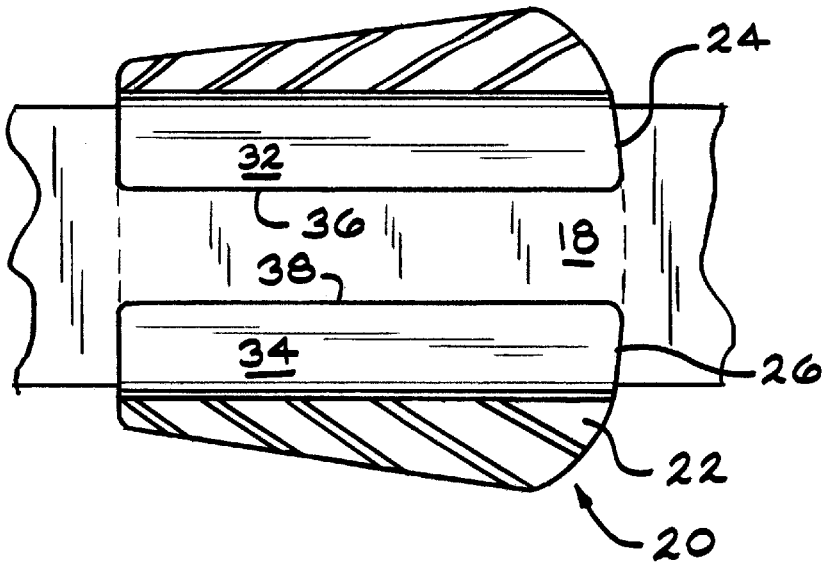
FIG. 2 top view of the strap guide shown in FIG. 1.
Figure 3:
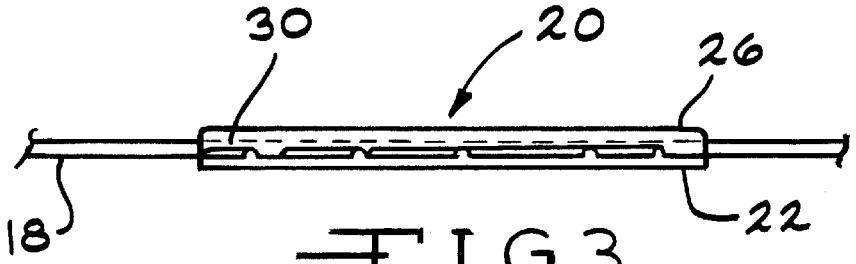
FIG. 3 is a side view of the strap guide shown in FIGS. 1 and 2.

Referring to FIG. 1, a helmet according to the present invention is indicated generally at 10. The helmet 10 has a face opening defined by an edge 12, and an elongated chin portion 14, which extends forward in an extreme way. Participants in extreme sports, including personal watercraft racing, snow-mobiling, motorcycle racing and snowboarding, use helmets like the helmet 10. Such helmets are generally open-faced and participants use a variety of goggles with such helmets for eye protection. Goggles, indicated generally at 16, are held in place by an elastic strap 18 that extends from the sides of the goggles 16 around the helmet 10.

A strap guide according to the present invention is indicated generally at 20. The strap guide 20 comprises a base 22, a first leg 24 and a second leg 26. The first and second legs 24 and 26 have first portions 28 and 30, which extend away from the base 22 a short distance, and second portions 32 and 34, which extend from the first portions 28 and 30 towards each other, and terminate in edges 36 and 38, which are spaced from each other. The base 22 is larger than the area covered by the second portions 32 and 34 of the first and second legs 24 and 26, and this is desirable. Such an oversized base provides good stability and excellent support for the first and second legs 24 and 26. It will be appreciated, however, that a strap guide according to the present invention can have a base that is smaller than the base 22. For example, a base that has a footprint corresponding with the area covered by the second portions 32 and 34 of the first and second legs 24 and 26 is adequate.

Figure 4:
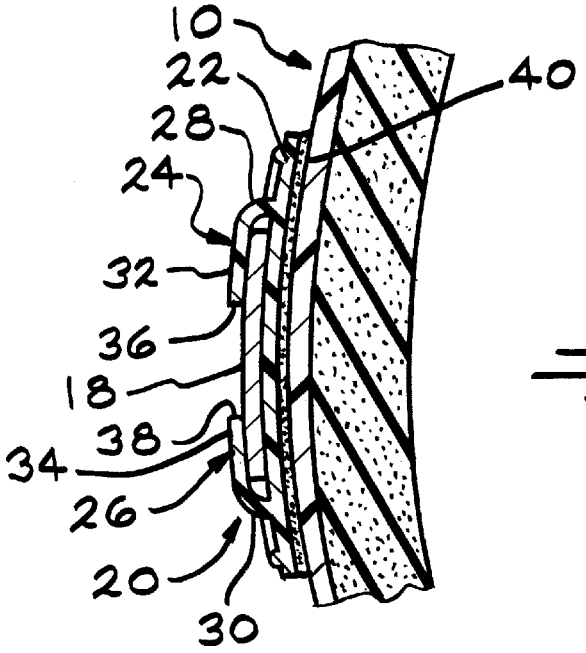
FIG. 4 is a cross-sectional view taken along the line 4—4 of FIG. 1

As shown in FIG. 1 and, in detail, in FIG. 4, the strap guide 20 is secured to the side of the helmet 10. As shown in FIG. 4, a piece of two-sided adhesive tape 40 is positioned between the base 22 of the strap guide 20 and the helmet 10. It is preferred that the two sided tape 40 cover the entire base 22. The strap guide is provided with the two-sided tape secured thereto, with the exposed side of the two-sided tape covered by release paper (not shown). In preparation for using the strap guide, the release paper would be removed and the strap guide would be positioned on the helmet in a desired location and pressed thereto, so that the exposed adhesive securely bonds the strap guide 20 to the helmet 10. Desirably, two strap guides 20 would be secured to the helmet 10, on opposite sides, so as to provide a means for maintaining a goggle strap 18 in a desirable position. Alternatively, a sheet of hook or loop fabric (not shown) can be adhesively secured to the base 22 of the strap guide and adhesively-backed mating hook or loop fabric can be supplied with the strap guide 20. In that case, the hook or loop fabric would be adhesively secured to the helmet 10 in a desired location and the corresponding hook or loop fabric on the base 22 would be pressed thereon, thereby securely, but releasably, fastening the strap guide 20 to the helmet 20. Because of the extreme conditions of use for such helmets, a hook and loop fabric connector would need to have extremely strong gripping properties.

With the strap guides 20 secured to the helmet 10, the strap 18 is manipulated so that an upper portion of the strap is positioned between the second portion 32 of the first leg 24 and the base 22, and so that a lower portion of the strap is positioned between the second portion 34 of the second leg 26 and the base 22, as shown in FIGS. 1 through 4. A typical strap has a width of between about 1 and ½ inches and 2 inches. As shown in FIG. 4, the first portions 28 and 30 of the legs 24 and 26 are spaced apart a distance corresponding with an average width for a strap 18. Once the strap is positioned in the strap guide 20, movement of the strap upwardly and downwardly is restricted. However, the strap 18 can slide forward or backward, to allow the goggles 16 to be properly positioned for the person wearing the helmet.

It is preferred that the strap guide be formed of a fairly rigid material which is just flexible enough to conform, if necessary, to the curvature found on the surface of a helmet 10. Suitable materials include rubber and various polymers, which are well known to those of ordinary skill in this art.

Figure 5:
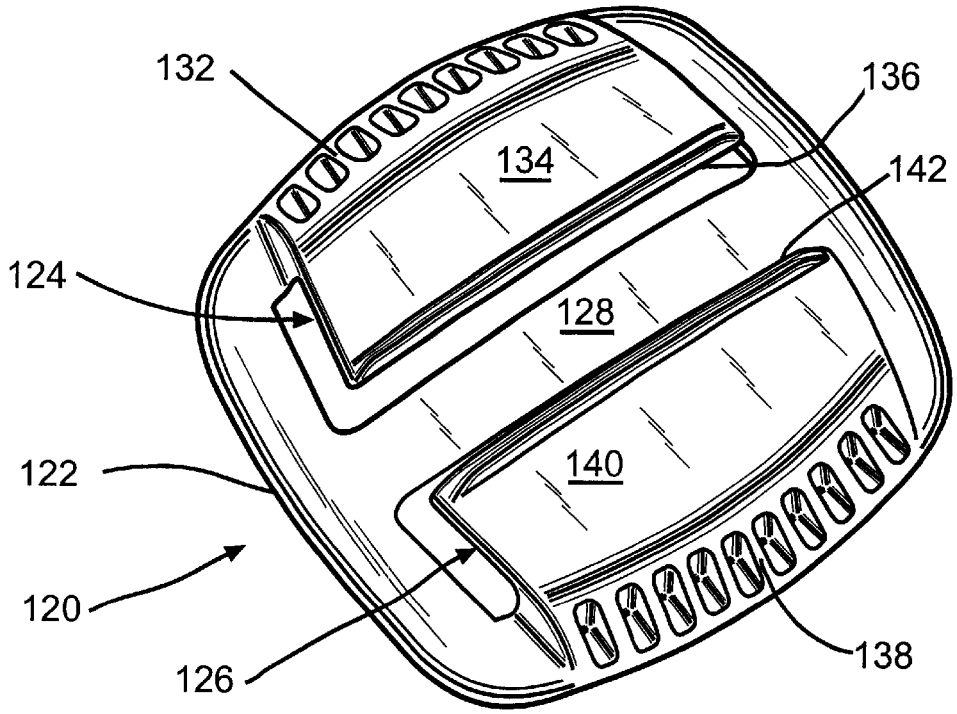
FIG. 5 is a perspective view of a preferred embodiment of the strap guide of the present invention.
Figure 6:
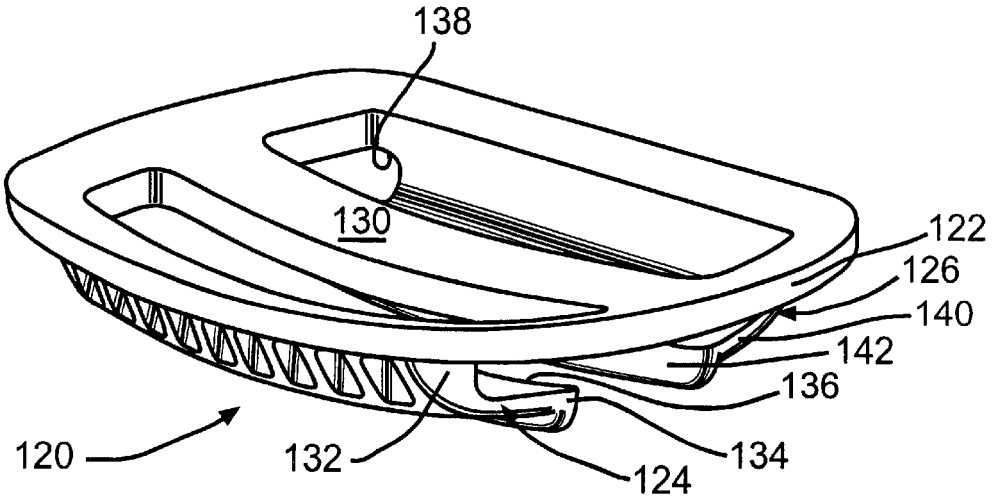
FIG. 6 is a second perspective view of the strap guide of the present invention.

Referring now to FIGS. 5 and 6, a preferred embodiment of a strap guide is indicated generally at 120. The strap guide 120 comprises a base 122, a first leg 124 and a second leg 126. The first and second legs 124 and 126 extend from a first side 128 of the base 122. A second side 130 of the base 122 is opposite the first side 128. The second side 130 is concave and the curvature of the concavity is preferably controlled so that it approximates the curvature of a convex portion of a helmet adjacent to and behind a face opening such as the one defined by the edge 12 (FIG. 1) on the helmet 10, in a location where the strap guide 120 is likely to be affixed to such a helmet 10. Good results have been achieved with a base 122 having a concavity having a radius of curvature of 5.6 inches.

The first leg 124 has a first portion 132, which extends away from the base 122 a short distance, and a second portion 134, which extends from the first portion 132 towards the second leg 126. The second portion 134 of the first leg 124 terminates in a free edge 136. The second leg 126 is, although it does not have to be, a mirror image of the first leg 124. The second leg 126 has a first portion 138, which extends away from the base 122 a short distance, and a second portion 140, which extends from the first portion 138 towards the first leg 124. The second portion 140 of the second leg 126 terminates in a free edge 142. The free edge 136 is parallel to the free edge 142 and spaced therefrom a distance roughly equal to the length of the second portions 134 and 140 of the first and second legs 124 and 126. The spacing between the free edges 136 and 142 is such that a goggle strap may be readily slipped between them and under the second portions 134 and 140, for sliding movement between them and the first side 128 of the base 122. The second portions 134 and 140 of the legs 124 and 126 are shown as having equal lengths, although this is not critical to the function of the strap guide 120. It is preferred, however.

The base 122 of the strap guide 120 is configured so that the second side 130 of the base 122 may secured by adhesive (not shown), adhesive tape (not shown), or other means, such as hook and loop fasteners (not shown), to a helmet 10, in the manner shown in FIGS. 1 and 4 for the strap guide 20. A Preferred material for the strap guide 120 is polycarbonate.

The strap guide 120 is used in the same manner as the strap guide 20. A pair of strap guides 120 are secured to opposite sides of a helmet (not shown), and a strap from a pair of goggles is manipulated into the space between the first side 128 of the base 122, and the second portions 134 and 140 of the first and second legs 124 and 126. Once the strap is positioned in the strap guides 120, movement of the strap upwardly and downwardly is restricted. However, the strap can slide forward or backward, to allow the goggles 16 to be properly positioned for the person wearing the helmet.

The foregoing description is intended to enable those skilled in the art to make and use the strap guide of the present invention. It will be appreciated that this invention, as disclosed, is susceptible of modification and change from what is described herein, without departing from the spirit and scope of this invention.

I claim:

1. A strap guide comprising a base having a first side and a second side, a first leg connected to said base, said first leg having a first portion which extends away from said first side of said base a short distance and a second portion connected to said first portion, said second portion terminating in a free edge, a second leg connected to said base, said second leg having a first portion which extends away from said first side of said base a short distance and a second portion connected to said first portion, said second portion terminating in a free edge, wherein said second portions of said first and second legs are spaced from said first side of said base a distance sufficient to accommodate the thickness of a goggle strap so that a goggle strap can slide longitudinally between said base and said second portions of said first and second legs, wherein said second portions of said first and second legs are operable to retain a goggle strap between said first side of said base and said second portions of said first and second legs, wherein said first portions of said first and second legs are spaced a part a distance sufficient to accommodate the width of a goggle strap, and are operable to restrict lateral movement of a goggle strap positioned therebetween, and wherein said free edges of said second portions of said first and second legs are spaced apart a distance which is roughly equal to the length of said first and second legs between said free edges and said first portions of said first and second legs.

2. The strap guide claimed in claim 1 which further comprises adhesive on said second side of said base for securing the strap guide to a helmet.

3. The strap guide claimed in claim 1 wherein said first portions of said first and second legs are connected to said base adjacent to opposed edges of said base.

4. The strap guide claimed in claim 3 which further comprises adhesive on said second side of said base for securing the strap guide to a helmet.

5. The strap guide claimed in claim 1 wherein said second side of said base is concave.

6. The strap guide claimed in claim 5 which further comprises adhesive on said second side of said base for securing the strap guide to a helmet.

7. The strap guide claimed in claim 5 wherein said first side of said base is convex.

8. The strap guide claimed in claim 1 wherein said first side of said base is convex.

9. A strap guide comprising a base having a first side and a second side, a first leg connected to said base, said first leg having a first portion which extends away from said first side of said base a short distance and a second portion connected to said first portion, said second portion terminating in a free edge, a second leg connected to said base, said second leg having a first portion which extends away from said first side of said base a short distance and a second portion connected to said first portion, said second portion terminating in a free edge which is parallel to the free edge of the second portion of said first leg, wherein said second portions of said first and second legs are spaced from said first side of said base a distance sufficient to accommodate the thickness of a goggle strap so that a goggle strap can slide longitudinally between said base and said second portions of said first and second legs, wherein said second portions of said first and second legs are operable to retain a goggle strap between said first side of said base and said second portions of said first and second legs, and wherein said first portions of said first and second legs are spaced a part a distance sufficient to accommodate the width of a goggle strap, and are operable to restrict lateral movement of a goggle strap positioned therebetween.

10. The strap guide claimed in claim 9 wherein said free edges of said second portions of said first and second legs are spaced apart a distance which is roughly equal to the length of said first and second legs between said free edges and said first portions of said first and second legs.

* * * * *